US010714051B1

(12) United States Patent
Huang et al.

(10) Patent No.: US 10,714,051 B1
(45) Date of Patent: Jul. 14, 2020

(54) DRIVING APPARATUS AND DRIVING SIGNAL GENERATING METHOD THEREOF

(71) Applicant: Au Optronics Corporation, Hsinchu (TW)

(72) Inventors: Sheng-Yao Huang, Hsinchu (TW); Hung-Chi Wang, Hsinchu (TW); Ya-Fang Chen, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 16/542,331

(22) Filed: Aug. 16, 2019

(30) Foreign Application Priority Data

Jan. 21, 2019 (TW) ..... 108102276 A

(51) Int. Cl.
*G09G 5/00* (2006.01)
*G09G 5/18* (2006.01)

(52) U.S. Cl.
CPC ..... *G09G 5/008* (2013.01); *G09G 5/18* (2013.01); *G09G 2370/08* (2013.01)

(58) Field of Classification Search
None
See application file for complete search history.

(56) References Cited

U.S. PATENT DOCUMENTS

| | | | | |
|---|---|---|---|---|
| 9,076,398 | B2 | 7/2015 | Su et al. | |
| 9,536,495 | B2 | 1/2017 | Amirkhany et al. | |
| 9,583,070 | B2 | 2/2017 | Lin et al. | |
| 10,032,414 | B2 | 7/2018 | Kim et al. | |
| 10,134,272 | B2 * | 11/2018 | Wiley | G08C 19/16 |
| 2013/0088531 | A1 | 4/2013 | Su et al. | |
| 2015/0109353 | A1 * | 4/2015 | Yu | G11C 19/28 345/691 |
| 2016/0189621 | A1 | 6/2016 | Kim et al. | |
| 2016/0284313 | A1 | 9/2016 | Lin et al. | |

FOREIGN PATENT DOCUMENTS

| | | |
|---|---|---|
| CN | 1713480 | 12/2005 |
| CN | 105741760 | 7/2016 |
| CN | 106023910 | 10/2016 |
| TW | 201316311 | 4/2013 |

* cited by examiner

*Primary Examiner* — Duane N Taylor, Jr.
(74) *Attorney, Agent, or Firm* — JCIPRNET

(57) ABSTRACT

A driving apparatus and a driving signal generating method are provided. The driving apparatus includes a timing controller, a driver, a switch and a resistor. The timing controller generates a bi-direction lock signal. The driver receives a differential signal pair. The switch is turned on or cut off according to an eye diagram detection result of the differential signal pair. According to the bi-direction lock signal, the timing controller and the driver are used to: operate a first clock and data recovery (CDR) operation on the differential signal pair during a first time period; set setting parameters of an output differential voltage, a pre-emphasis circuit and an equalizer according to the eye diagram detection result and an on/off state of the switch, and perform a second CDR operation during a second time period; and drive a display according to the differential signal pair during a third time period.

20 Claims, 6 Drawing Sheets

DRIVING APPARATUS AND DRIVING SIGNAL GENERATING METHOD THEREOF

CROSS-REFERENCE TO RELATED APPLICATION

This application claims the priority benefit of Taiwan application serial no. 108102276, filed on Jan. 21, 2019. The entirety of the above-mentioned patent application is hereby incorporated by reference herein and made a part of this specification.

BACKGROUND

Technical Field

The present disclosure relates to a driving apparatus and a driving signal generating method, and more particularly to a driving apparatus and a driving signal generating method for a display.

Description of Related Art

As the size and resolution of the display panel increase, the signal attenuation that may occur on the signal transmission path for transmitting display data in the display becomes more serious. In the known technologies, in order to overcome the influence caused by signal attenuation, the timing controller terminal adopts an output differential voltage (VOD) with an increased driving capability and a pre-emphasis (PEMP) circuit, and the driver (source driver) terminal adopts an equalizer (EQ) to solve the problem of signal attenuation.

However, in the known technologies, the setting parameters related to output differential voltage, the pre-emphasis circuit, and the equalizer are fixed, and different panel sizes and positions of different driving chips will affect the setting parameters of the above three technologies. It is an important issue for practitioners of the field to find out the optimal setting parameters corresponding to various drivers and timing controllers.

SUMMARY

The present disclosure provides a driving apparatus and a driving signal generating method for improving transmission quality of a differential signal pair.

The driving apparatus of the present disclosure is adapted for a display. The driving apparatus includes a timing controller, at least one driver, at least one switch, and at least one resistor. The timing controller provides an output differential voltage and has a pre-emphasis circuit, and the timing controller receives the bi-direction lock signal. The at least one driver having an equalizer coupled to the timing controller and receiving a dynamic signal pair through the first data line and the second data line. The at least one driver receives at least one lock signal. The at least one switch is coupled between the first data line and the second data line, and the at least one switch is turned on or cut off according to the eye diagram detection result of the differential signal pair. The at least one resistor and the at least one switch are connected in series between the first data line and the second data line. According to the bi-direction lock signal, the timing controller and the at least one driver are configured to: perform the first clock and the data synchronization operation on the differential signal pair in the first time period; and set the setting parameters of the output differential voltage, the pre-emphasis circuit, and the equalizer according to the eye diagram detection result and an on or off state of the at least one switch and perform the second clock and the data synchronization operation on the differential signal pair in the second time period; drive the display according to the differential signal pair in the third time period.

The driving signal generating method of the present disclosure includes: providing a timing controller having a pre-emphasis circuit and providing an output differential voltage, wherein the timing controller receives the bi-direction lock signal; providing at least one driver having an equalizer, and receiving the differential signal pair by the timing controller through the first data line and the second data line; providing at least one switch and at least one resistor connected in series between the first data line and the second data line; performing the first clock and the data synchronization operation on the differential signal pair during the first time period according to the bi-direction lock signal; according to the bi-direction lock signal, setting the setting parameters of the output differential voltage, the pre-emphasis circuit and the equalizer according to the eye diagram detection result of the differential signal pair and the on or off state of the at least one switch, and performing the second clock and the data synchronization operation on the differential signal pair during the second time period; and according to the bi-direction lock signal, driving the display according to the differential signal pair during the third time period, wherein the at least one switch is turned on or cut off according to the eye diagram detection result of the differential signal pair.

Based on the above, the present disclosure provides a switch connected in series between the first data line and the second data line transmitting the differential signal pair, and the switch is turned on or cut off according to an eye diagram detection result of the differential signal pair. Moreover, the present disclosure defines three time periods through the bi-direction lock signal, and configured to set the setting parameters of the output differential voltage, the pre-emphasis circuit, and the equalizer to actively adjust the transmission properties of the differential signal pair, thereby improving the reliability of signal transmission.

In order to make the aforementioned features and advantages of the disclosure more comprehensible, embodiments accompanying figures are described in detail below.

DESCRIPTION OF THE EMBODIMENTS

Figure 1:
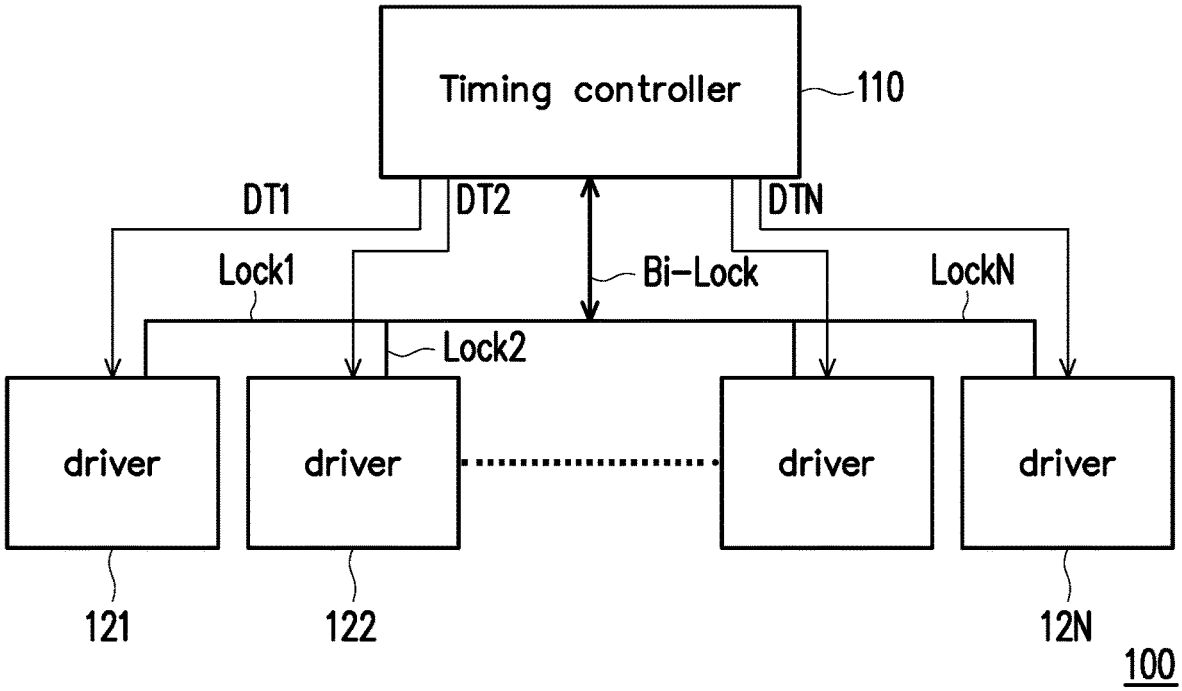
FIG. 1 is a schematic diagram of a driving apparatus according to an embodiment of the disclosure.

Please refer to FIG. 1. FIG. 1 is a schematic diagram of a driving apparatus according to an embodiment of the disclosure. A driving apparatus 100 is adapted for a display, and the driving apparatus 100 includes a timing controller 110 and one or more drivers 121~12N. The timing controller 110 provides an output differential voltage and has a pre-emphasis circuit. The timing controller 110 is coupled to the drivers 121~12N, receives the lock signals Lock1~LockN respectively generated by the drivers 121~12N, and generates a bi-direction lock signal Bi-Lock according to the lock signals Lock1~LockN. The timing controller 110 transmits the differential signal pairs DT1~DTN to the drivers 121~12N, respectively. Please refer to FIG. 1 and FIG. 2, wherein FIG. 2 is a block diagram showing the circuit structure of a driving apparatus according to an embodiment of the disclosure.

Figure 2:
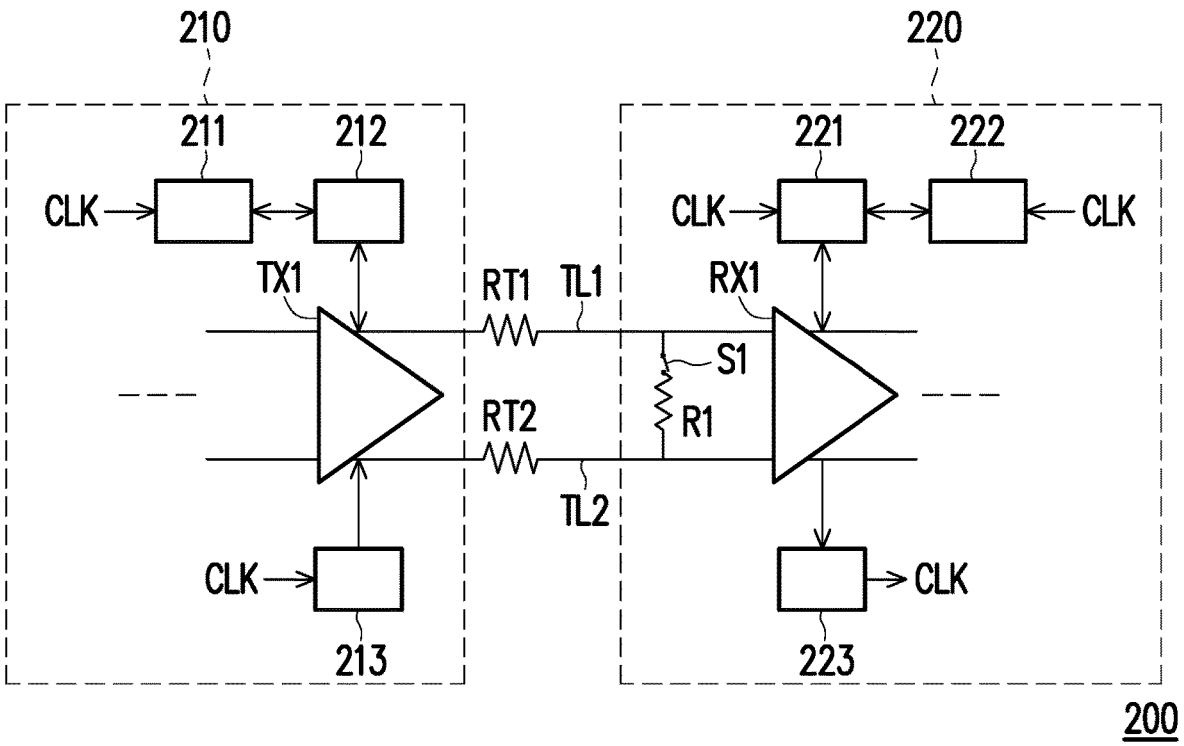
FIG. 2 is a block diagram showing the circuit structure of a driving apparatus according to an embodiment of the disclosure.

In FIG. 2, a driving apparatus 200 includes a timing controller 210, a driver 220, a switch S1, and a resistor R1. The timing controller 210 transmits a differential signal pair to the driver 220 through data lines TL1 and TL2. The data lines TL1 and TL2 are provided with parasitic resistors RT1 and RT2, respectively. In addition, the switch S1 and the resistor R1 are connected in series and coupled between the data lines TL1 and TL2.

In this embodiment, the timing controller 210 includes a counter 211, a current detecting circuit 212, an amplifier TX1, and a phase lock loop 213. The driver 220 includes an amplifier RX1, an eye diagram detecting circuit 221, a counter 222, and a clock and data synchronization circuit 223. Regarding the operation, the timing controller 210 and the driver 220 can perform operations according to the bi-direction lock signal Bi-Lock. In this embodiment, according to the voltage value of the bi-direction lock signal Bi-Lock, the timing controller 210 and the driver 220 can operate in different time periods. Specifically, the bi-direction lock signal Bi-Lock in the embodiment can be adjusted between three voltage values. When the bi-direction lock signal Bi-Lock is maintained at the first voltage value, the timing controller 210 and the driver 220 are operable in the first time period; when the bi-direction lock signal Bi-Lock is maintained at the second voltage value, the timing controller 210 and the driver 220 are operable in the second time period; and when the bi-direction lock signal Bi-Lock is maintained at the third voltage value, the timing controller 210 and the driver 220 are operable in the third time period, wherein the first voltage value, the second voltage value and the third voltage value are different.

In the first time period, the driver 220 initially sets the lock signal (for example, the lock signal Lock1) generated thereby to the fourth voltage value, and the timing controller 210 initially sets the bi-direction lock signal Bi-Lock generated thereby to the first voltage value. On the other hand, the driver 220 receives the differential signal pair transmitted by the timing controller 210, and performs the clock and data synchronization operation on the differential signal pair. The clock and data synchronization operation can be performed by the clock and data synchronization circuit 223 to perform clock and data recovery (CDR) operation, and the data transmission between the driver 220 and the timing controller 210 can be performed simultaneously. On this occasion, the timing controller 210 can transmit the training code to the driver 220, and makes the driver 220 to perform the clock and data synchronization operation according to the training code. In the present embodiment, the clock and data synchronization circuit 223 can be implemented by using the circuit commonly known to those skilled in the art, the disclosure provides no limitation thereto.

After the clock and data synchronization operation is completed, the driver 220 adjusts the lock signal Lock1 to the fifth voltage value, and the timing controller 210 adjusts the bi-direction lock signal Bi-Lock to the second voltage value corresponding to the voltage change of the lock signal Lock1 and enters the second time period.

Then, in the second time period, the timing controller 210 generates the differential signal pair to be transmitted to the driver 220 according to a test pattern. The driver 220 can detect the eye diagram of the received differential signal pair through the eye diagram detecting circuit 221, and generate an eye diagram detection result. Moreover, when performing the eye diagram detecting operation on the differential signal pair, the driver 220 can dynamically adjust the setting parameters of the equalizer within the driver 220, and set the setting parameters of the equalizer within the driver 220 according to the eye diagram detection result.

On the other hand, the driver 220 turns on or cuts off the switch S1 according to the eye diagram detection result. In the same second time period, the timing controller 210 detects the on or off state of the switch S1 through the current detecting circuit 212. At the same time, the timing controller 210 can dynamically adjust the generated output differential voltage and the setting parameter of the pre-emphasis circuit within the timing controller 210. The timing controller 210 performs the setting operation of the setting parameters of the output differential voltage and the pre-emphasis circuit according to the change of the on or off state of the switch S1.

Specifically, in the second time period, the timing controller 210 and the driver 220 dynamically adjust the setting parameter of the output differential voltage, the setting parameter of the pre-emphasis circuit, and the setting parameter of the equalizer in synchronization with time. The timing controller 210 transmits differential signal pairs to the driver 220 corresponding to different setting parameters of output differential voltages and pre-emphasis circuits. The driver 220 applies the setting parameter of the corresponding equalizer, and receives and performs the eye diagram detecting operation on the differential signal pair. When the eye diagram detection indicates that the reception of the differential signal pair is normal, the driver 220 can correspondingly cut off the switch S1 and complete the setting operation of the setting parameter of the equalizer. By detecting the on or off state of the switch S1, the timing controller 210 can know that the setting parameters of the output differential voltage and the pre-emphasis circuit are preferred values at the moment the switch S1 is cut off, and correspondingly completes the setting operation on the setting parameters of the output differential voltage and the pre-emphasis circuit.

It should be mentioned that when the switch S1 is cut off, in order to maintain the normal transmission operation of the differential signal pair, the switch S1 needs to be quickly restored to the on state. However, in the time period in which the switch S1 is cut off, a state in which the clock count between the timing controller 210 and the driver 220 is asynchronous is generated, and therefore, in the second time period, after the setting operation on the setting parameters of the output differential voltage, the pre-emphasis circuit, and the equalizer is completed, the driver 220 needs to perform the clock and data synchronization operation for a second time. The driver 220 adjusts the lock signal Lock1 to the sixth voltage value after the second time of clock and data synchronization operation is completed. The timing controller 210 adjusts the bi-direction lock signal Bi-Lock to the third voltage value corresponding to the change of the voltage value of the lock signal Lock1, and enters the third time period.

It should be mentioned that the fourth voltage value, the fifth voltage value and the sixth voltage value may be the same as the first voltage value, the second voltage value and the third voltage value, respectively, or may be partially the same or completely different, there disclosure provides no specific limitation thereto. The fourth voltage value, the fifth voltage value, and the sixth voltage value are all different.

Further, in the second time period, the adjustment operation on the setting parameters of the output differential voltage and the pre-emphasis circuit performed by the timing controller 210 can be performed through the counter 211 according to the clock signal CLK. The setting parameters of the output differential voltage and the pre-emphasis circuit can be divided into multiple groups and each group of setting parameters can be encoded. The counter 211 can count according to the clock signal CLK, and obtain the count value corresponding to the counting operation. Taking the count value equal to A as an example, the timing controller 210 can extract the setting parameter coded as A as the setting parameters of the output differential voltage and the pre-emphasis circuit, and perform setting operation on the electrical parameters of the output differential voltage and the pre-emphasis circuit. When the count value is equal to A+1, the timing controller 210 can make a change to use the setting parameter coded as A+1 as the setting parameters of the output differential voltage and the pre-emphasis circuit. If the timing controller 210 detects that the switch S1 is cut off when the count value is equal to A+2, the timing controller 210 can record A+2 and set and maintain the setting parameters of the output differential voltage and the pre-emphasis circuit according to the setting parameter coded as A+1.

In this embodiment, in the example where there are 128 groups of setting parameters, the count value may have at least 7 bits.

Similarly, the adjustment of the setting parameter of the equalizer of the driver 220 can be performed by the counter 222 according to the clock signal CLK. The operation method of the counter 222 is similar to that of the counter 211, and will not be described here.

Then, in the third time period, the timing controller 210 can perform a general data (display data) transmission operation, and the driver 220 can perform the driving operation on the display according to the differential signal pair.

It should be particularly noted that when the number of the drivers 220 is multiple, the voltage adjustment operation performed by the timing controller 210 on the bi-direction lock signal Bi-Lock will be performed after the voltage adjustment is performed on all the lock signals of the drivers 220, thereby ensuring that all drivers 220 can receive the correct differential signal pair. The output mechanism of the output differential voltage and the pre-emphasis circuit can be set in the amplifier TX1, and the equalizer can be set in the amplifier RX1. The output mechanism of the output differential voltage, the circuit configuration of the pre-emphasis circuit and the equalizer can be implemented by using a circuit commonly known to those skilled in the art, the disclosure provides no limitation thereto. The setting parameter of the output differential voltage can be used to set the magnitude of the driving current of the output differential voltage; the setting parameter of the pre-emphasis circuit can be used to set the magnitude of the output current of the pre-emphasis circuit in a specific time period; the setting parameter of the equalizer can be used to set the bandwidth for the equalizer to perform signal compensation.

Figure 3:
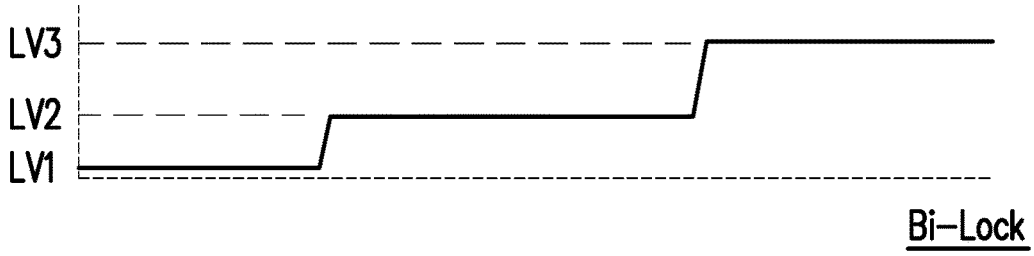
FIG. 3 is a schematic diagram showing the waveform of a bi-direction lock signal according to an embodiment of the present disclosure.

Please refer to FIG. 3 below, FIG. 3 is a schematic diagram showing the waveform of a bi-direction lock signal according to an embodiment of the present disclosure. In FIG. 3, the bi-direction lock signal Bi-Lock can be maintained at different voltage values in different time periods. Specifically, the bi-direction lock signal Bi-Lock may be maintained at the first voltage value LV1 during the first time period; maintained at the second voltage value LV2 during the second time period; and maintained at the third voltage value LV3 during the third time period. In this embodiment, the first voltage value LV1 is smaller than the second voltage value LV2, and the second voltage value LV2 is smaller than the third voltage value LV3. In other embodiments of the present disclosure, there is no limitation to the voltage magnitude relationship between the first voltage value LV1, the second voltage value LV2, and the third voltage value LV3.

Figure 4:
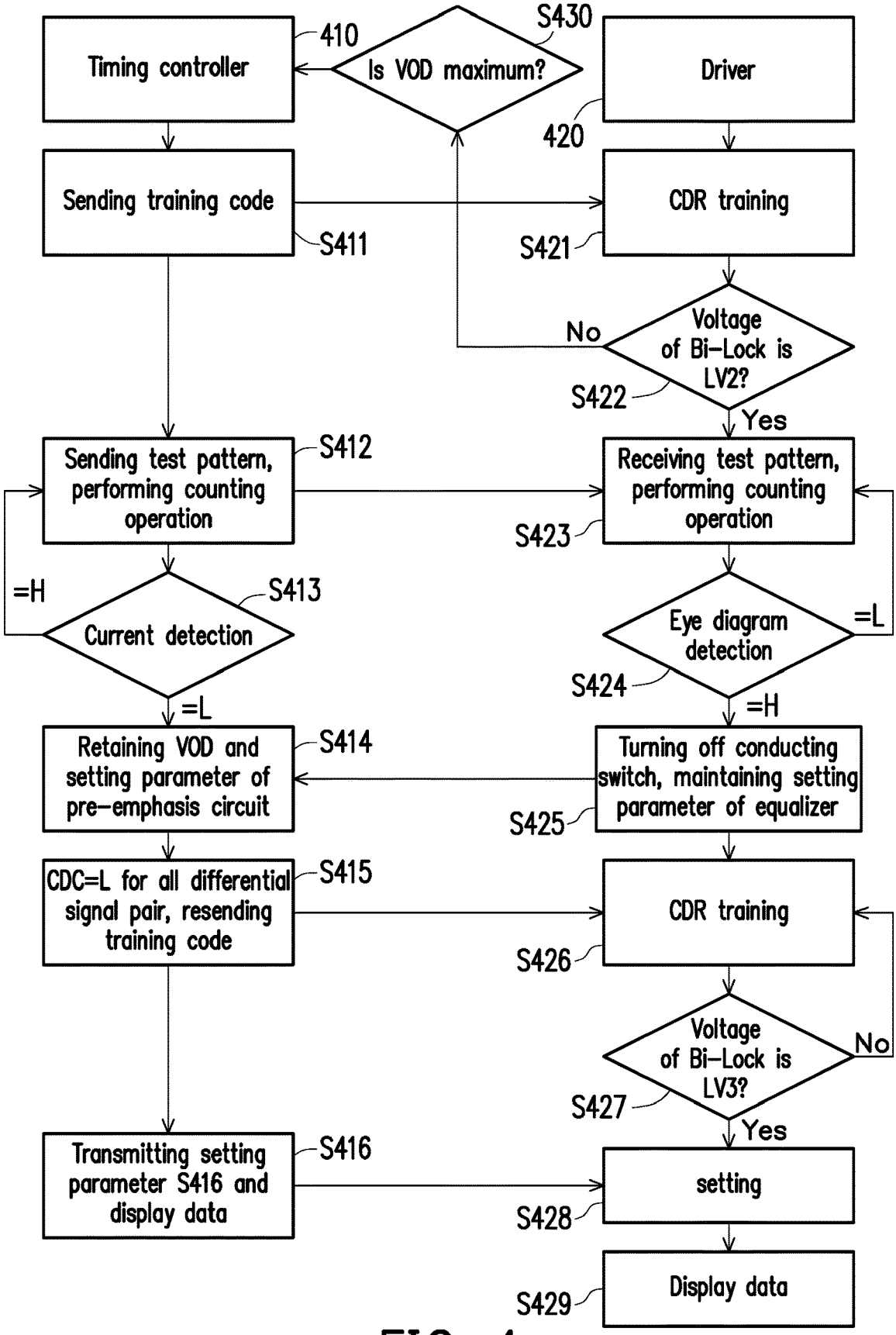
FIG. 4 is a flow chart showing a driving signal generating method according to an embodiment of the present disclosure.

Please refer to FIG. 4 below, FIG. 4 is a flow chart showing a driving signal generating method according to an embodiment of the present disclosure. In FIG. 4, a timing controller 410 transmits the training code to a driver 420 in step S411, and causes the driver 420 to perform clock and data synchronization (CDR) training in step S421 according to the training code. When the step S421 is completed, the driver 420 changes the voltage value of the lock signal. The driver 420 performs the determining operation on the voltage value of the bi-direction lock signal Bi-Lock in step S422, and when the voltage value of the bi-direction lock signal Bi-Lock is equal to the second voltage value LV2, step S423 is performed. In contrast, when the driver 420 determines in step S422 that the voltage value of the Bi-Lock has not been adjusted to the second voltage value LV2, step S430 is performed to determine whether the driving capability of the output differential voltage (VOD) has been adjusted to the maximum value, and the detection result is transmitted to the timing controller 410.

In step S412, the timing controller 410 sends the test pattern to the driver 420 and performs a counting operation. The driver 420 receives the test pattern in step S423 and performs the counting operation according to the test pattern. The counting operation of the timing controller 410 and the driver 420 may be in synchronization, and configured to simultaneously adjust the setting parameters of the output differential voltage (VOD), the pre-emphasis circuit, and the equalizer. The timing controller 410 performs current detection in step S413, and detects the on or off state of the switch between the transmission wires through current detection. The driver 420 performs an eye diagram detecting operation in step S424, and controls the on or off state of the switch according to the eye diagram detection result. In this embodiment, when the current detection result performed in step S413 is logical high level (H), step S412 is performed again. In contrast, when the current detection result performed in step S413 is logical low level (L), step S414 is performed. When the eye diagram detection result of the eye diagram detecting operation performed in step S424 is logical low level (L), step S423 is performed again. In contrast, when the eye diagram detection result of the eye diagram detecting operation performed in step S424 is logical high level (H), step S425 is performed. With regard to the execution details of step S413 and step S424, a detailed description will be provided in the following embodiments.

In step S414, the timing controller 410 can retain the setting parameters of the output differential voltage (VOD) and the pre-emphasis circuit. In step S425, the driver 420 causes the switch to be cut off first and then turned on, and maintains the setting parameter of the equalizer. Then, in step S415, when the timing controller 410 waits for the current detection result (CDC) of the current detecting operation performed on all the differential signal pairs to be the logical low level (L), the timing controller 410 retransmits the training code to the driver 420. The driver 420 performs the CDR training again in step S426. The driver 420 adjusts the voltage value of the lock signal after the CDR training is completed. The timing controller 410 can adjust the voltage value of the bi-direction lock signal Bi-Lock (adjust to the third voltage value LV3) after the voltage values of all the lock signals are adjusted. In step S427, the driver 420 determines whether the voltage value of the bi-direction lock signal Bi-Lock is the third voltage value LV3, if the determining result is negative, the process proceeds to step S426; in contrast, if the determining result is positive, step S428 is performed.

Next, in step S416, the timing controller 410 performs a transmission operation on setting parameters and display data, and in step S428, performs a setting operation on the output differential voltage, the pre-emphasis circuit and the equalizer according to the setting parameters, and performs general transmission and driving operations on display data in step S429.

Figure 5:
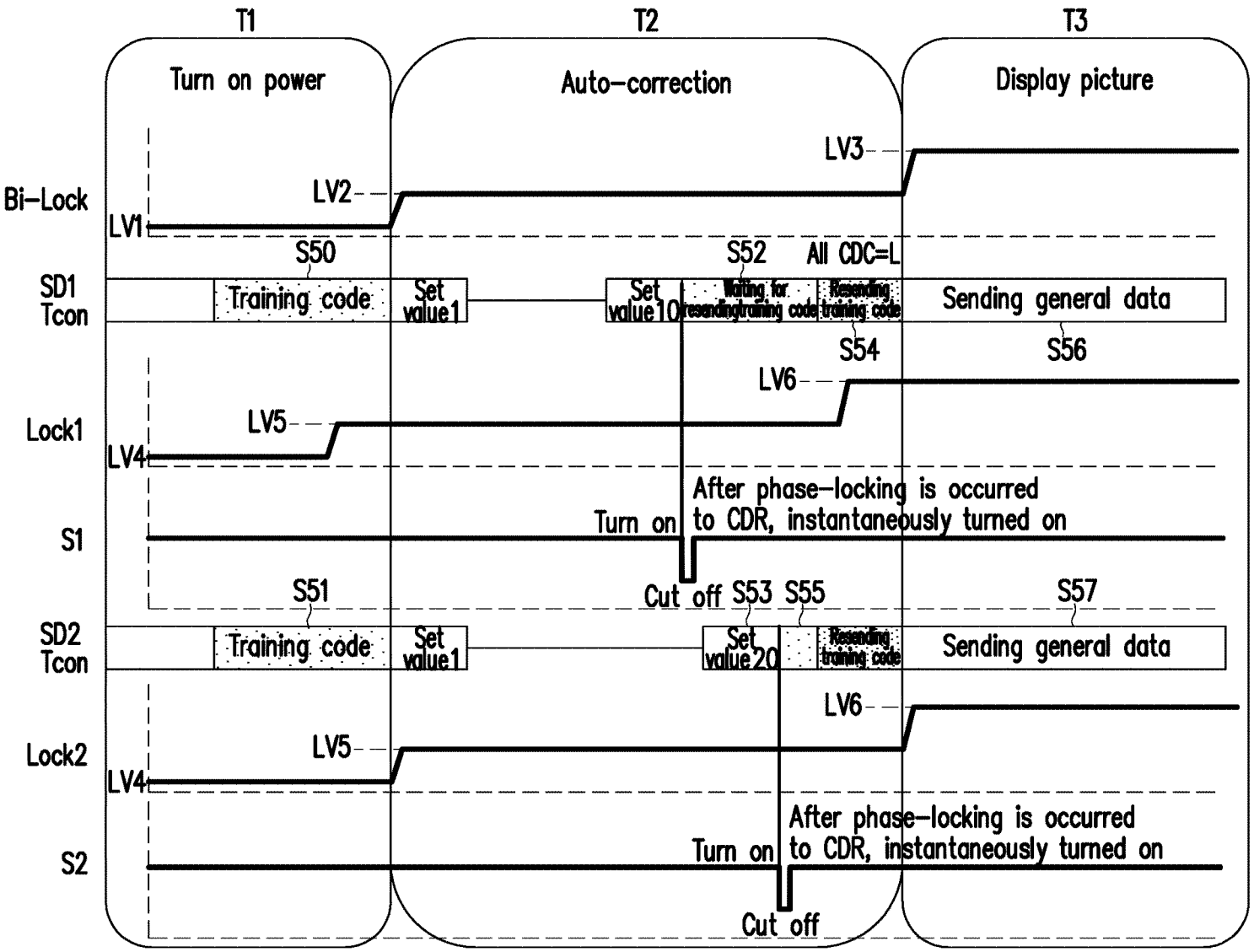
FIG. 5 is a flow chart showing the operation of a driving apparatus according to an embodiment of the present disclosure.

Please refer to FIG. 5, FIG. 5 is a flow chart showing the operation of a driving apparatus according to an embodiment of the present disclosure. In the first time period T1 when the power is turned on, the bi-direction lock signal Bi-Lock is set to the first voltage value LV1 by the timing controller Tcon. The drivers SD1 and SD2 coupled to the timing controller Tcon respectively set the generated lock signals Lock1 and Lock2 to the fourth voltage value LV4, wherein the first voltage value LV1 and the fourth voltage value LV4 may be the same or different. In the meantime, the switches S1 and S2 respectively corresponding to the drivers SD1 and SD2 are turned on.

In the first time period, the timing controller Tcon transmits the training code (steps S50, S51) to the drivers SD1 and SD2, and the drivers SD1 and SD2 respectively perform the clock and data synchronization operation for the first time according to the received training code. The drivers SD1 and SD2 adjust the lock signals Lock1 and Lock2 to the fifth voltage value LV5 after the respectively performed clock and data synchronization operations are completed. In this embodiment, the driver SD1 completes the clock and data synchronization operation earlier than the driver SD2, so the lock signal Lock1 transitions to the time point of the fifth voltage value LV5, earlier than the time point of the fifth voltage value LV5 of the lock signal Lock2.

When all the lock signals Lock1 and Lock2 are transitioned to the fifth voltage value LV5, the timing controller Tcon correspondingly adjusts the bi-direction lock signal Bi-Lock to the second voltage value LV2, and enters the second time period T2, wherein the second voltage value LV2 and the fifth voltage value LV5 may be the same or different.

In the second time period T2, the driving apparatus performs an automatic correcting operation. On this occasion, the timing controller Tcon and the drivers SD1 and SD2 sequentially adjust the setting parameters of the output differential voltage, the pre-emphasis circuit, and the equalizer according to the counting operation. With the dynamic adjustment operation on the set parameters, the drivers SD1 and SD2 perform the eye diagram detecting operation on the received differential signal pair, and the timing controller Tcon1 detects the on or off state of the switches S1 and S2 through the current detecting operation. In the embodiment, when the setting parameter is adjusted from the set value 1 to the set value 10, the driver SD1 passes the eye diagram detection result, and correspondingly cuts off the switch S1. On this occasion, the timing controller Tcon detects that the switch S1 is cut off, and proceeds to step S52 of waiting for the retransmission of training code. On the other hand, when the switch S1 is cut off, phase-locking is occurred to the clock and data synchronization (CDR) of the driver SD1 and the timing controller Tcon, and the switch S1 is instantaneously restored to the on state. On the other hand, when the setting parameter is adjusted from the set value 1 to the set value 20, the driver SD2 passes the eye diagram detection result and correspondingly cuts off the switch S2. In the meantime, the timing controller Tcon detects that the switch S2 is cut off and enters the step S53 of waiting for the retransmission of training code. On the other hand, when the switch S2 is cut off, phase-locking is occurred to the clock and data synchronization (CDR) of the driver SD2 and the timing controller Tcon, and the switch S2 is instantaneously restored to the on state.

After the timing controller Tcon detects that all the switches S1 and S2 are cut off and turned on again, the timing controller Tcon retransmits the training code to the drivers SD1 and SD2 (steps S54 and S55), and causes the drivers SD1 and SD2 to perform the clock and data synchronization operation for a second time. The drivers SD1 and SD2 respectively adjust the lock signals Lock1 and Lock2 to the sixth voltage value LV6 after the second time of clock and data synchronization operation is completed. The timing controller Tcon adjusts the bi-direction lock signal Bi-Lock to the third voltage value LV3 after all the lock signals Lock1 and Lock2 are adjusted to the sixth voltage value LV6, and enters the third time period T3. Specifically, the third voltage value LV3 and the sixth voltage value LV6 may be the same or different.

In the third time period T3, the driving apparatus performs a screen display operation. The timing controller Tcon transmits the general data (display data) as the differential signal pair to the drivers SD1 and SD2, and causes the drivers SD1 and SD2 to drive the display according to the received display data.

Figure 6:
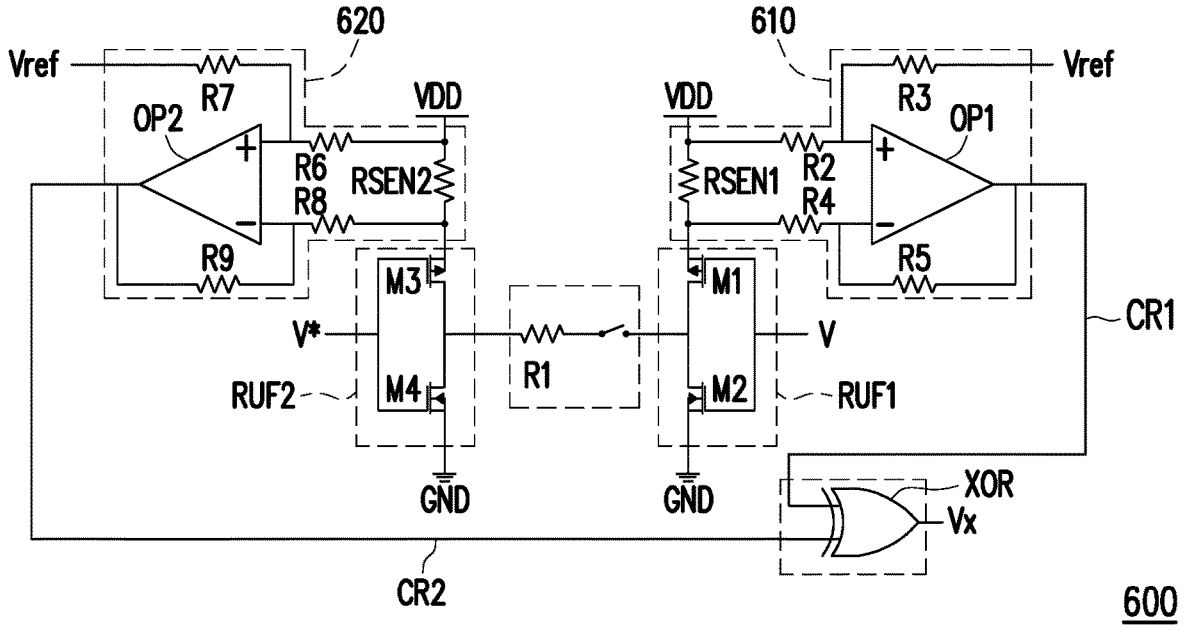
FIG. 6 is a schematic diagram showing an implementation of a current detecting circuit according to an embodiment of the present disclosure.

Please refer to FIG. 6, FIG. 6 is a schematic diagram showing an implementation of a current detecting circuit according to an embodiment of the present disclosure. A current detecting circuit 600 includes buffers BUF1 and BUF2, comparison circuits 610 and 620, and a logical operation circuit 630. The buffer BUF1 is coupled to a switch S1 and a resistor R1. The buffer BUF1 provides a first bias voltage to the switch S1 and the resistor R1 according to a control signal V. In this embodiment, the first bias voltage may be the power voltage VDD. The buffer BUF2 provides a second bias voltage to the switch S1 and the resistor R1 according to an inverted control signal V. In this embodiment, the second bias voltage may be a ground voltage on the reference ground GND. The comparison circuit 610 is coupled to the switch S1 and the resistor R1 through a detecting resistor RSEN1. The comparison circuit 610 compares the voltage difference between two terminals of the detecting resistor RSEN1 to generate a comparison result CR1. The comparison circuit 620 is coupled to the switch S1 and the resistor R1 through the detecting resistor RSEN2. The comparison circuit 620 compares the voltage difference between two terminals of the detecting resistor RSEN2 to generate a comparison result CR2. The logical operation circuit 630 performs a logical calculation on the comparison result CR1 and the comparison result CR2 to generate a determining result Vx, wherein the determining result Vx is either logical high level or logical low level, and is configured to indicate the on or off state of the switch S1.

In the present embodiment, the buffer BUF1 includes transistors M1 and M2. The first terminal of the transistor M1 receives the power voltage VDD through the detecting resistor RSEN1, the second terminal of the transistor M1 is coupled to one terminal of the switch S1, and the control terminal of the transistor M1 receives the control signal V. The first terminal of the transistor M2 is coupled to the second terminal of the transistor M1, the second terminal of the transistor M2 is coupled to the reference ground terminal GND, and the control terminal of the transistor M2 receives the control signal V. The buffer BUF2 includes transistors M3 and M4. The first terminal of the transistor M3 receives the power voltage VDD through the detecting resistor RSEN2, the second terminal of the transistor M3 is coupled to one terminal of the resistor R1, and the control terminal of the transistor M3 receives the inverted control signal V*. The first terminal of the transistor M4 is coupled to the second terminal of the transistor M3, the second terminal of the transistor M4 is coupled to the reference ground terminal GND, and the control terminal of the transistor M4 receives the inverted control signal V*.

The comparison circuit 610 includes an operation amplifier OP1 and resistors R2-R R5. The first terminal of the resistor R2 is coupled to the end point of the detecting resistor RSEN1 receiving the power voltage VDD, and the second terminal of the resistor R2 is coupled to the positive input terminal of the operation amplifier OP1. One terminal of the resistor R3 is coupled to the positive input terminal of the operation amplifier OP1, and the other terminal receives the reference voltage Vref. The resistor R4 is connected in series between the second terminal of the detecting resistor RSEN1 and the negative input terminal of the operation amplifier OP1. The resistor R5 is connected in series between the output terminal of the operation amplifier OP1 and the negative input terminal of the operation amplifier OP1, and the output terminal of the operation amplifier OP1 generates the comparison result CR1.

In addition, the comparison circuit 620 includes an operation amplifier OP2 and resistors R6-R9. The first terminal of the resistor R6 is coupled to the end point of the detecting resistor RSEN2 receiving the power voltage VDD, and the second terminal of the resistor R6 is coupled to the positive input terminal of the operation amplifier OP2. One terminal of the resistor R7 is coupled to the positive input terminal of the operation amplifier OP2, and the other terminal receives the reference voltage Vref. The resistor R8 is connected in series between the second terminal of the detecting resistor RSEN2 and the negative input terminal of the operation amplifier OP2. The resistor R9 is connected in series between the output terminal of the operation amplifier OP2 and the negative input terminal of the operation amplifier OP2, and the output terminal of the operation amplifier OP2 generates the comparison result CR2.

Regarding the operation, when performing the current detecting operation, the buffer BUF1 receives the control signal V and causes on the transistor M1 to be turned on (the transistor M2 is cut off). The buffer BUF1 supplies a bias voltage according to the power voltage VDD to be applied to one terminal of the switch S1. In the meantime, the buffer BUF2 receives the inverted control signal V* and causes the transistor M3 to be turned on (the transistor M4 is cut off). The buffer BUF2 supplies another bias voltage according to the ground voltage on the reference ground terminal GND to the other terminal of the switch S1. When the switch S1 is in the on state, a current path can be formed between the transistor M1, the switch S1, the resistor R1, and the transistor M4. In this way, a voltage difference can be generated between the two terminals of the detecting resistor RSEN1. The operation amplifier OP1 can generate a comparison result CR1 which is logical high level according to comparison of the voltage difference between the two terminals of the detecting resistor RSEN1. In contrast, when the switch S1 is cut off, the voltage difference between the two terminals of the detecting resistor RSEN1 is substantially equal to 0, and the operation amplifier OP1 correspondingly generates the comparison result CR1 which is logical low level.

As compared with the comparison circuit 610, based on the condition that the operation of the buffer BUF2 is complementary to the operation of the buffer BUF1, when the switch S1 is turned on, the comparison result CR2 generated by the comparison circuit 620 may be opposite to the comparison result CR1 generated by the comparison circuit 610. When the switch S1 is cut off, the comparison result CR2 generated by the comparison circuit 620 may be the same as the comparison result CR1 generated by the comparison circuit 610. Therefore, through the exclusive-OR gate XOR in the logical operation circuit 630, when the switch S1 is in the on state, the logical operation circuit 630 can generate the determining result Vx which is logical high level, and vice versa, when the switch S1 is in the off state, the logical operation circuit 630 can generate the determining result Vx which is logical low level.

Figure 7:
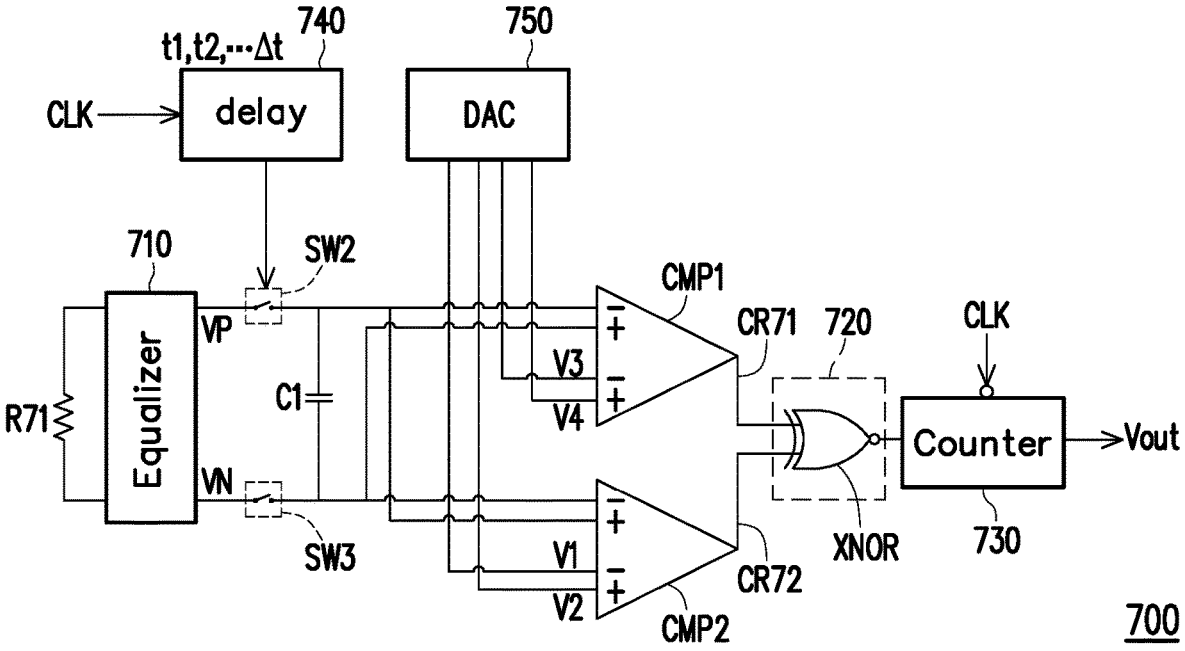
FIG. 7 is a schematic diagram showing an implementation of an eye diagram detecting circuit according to an embodiment of the present disclosure.

Please refer to FIG. 7. FIG. 7 is a schematic diagram showing an implementation of an eye diagram detecting circuit according to an embodiment of the present disclosure. An eye diagram detecting circuit 700 includes an equalizer 710, a delay 740, a digital to analog converter (DAC) 750, comparators CMP1 and CMP2, a logical operation circuit 720, and a counter 730. The equalizer 710 is connected to a resistor R71 for making the first differential signal VP and the second differential signal VN to perform equalizing operation in an initial state, and making the voltage values of the first differential signal VP and the second differential signal VN to be substantially the same in the initial state.

When the eye diagram detecting operation on the differential signal pair is performed, the voltage difference between the first differential signal VP and the second differential signal VN is amplified according to the differential signal pair, and on this occasion, the delay 740 turns on the switches SW2 and SW3 at a plurality of time points t1, t2, . . . , tn according to the clock signal CLK, and transmits the first differential signal VP and the second differential signal VN having different voltage values to the comparators CMP1 and CMP2 at time points t1, t2, . . . , tn. Incidentally, a capacitor C1 is connected in series between the two transmission wires of the first differential signal VP and the second differential signal VN.

The comparison circuit CMP1 receives the voltages V3 and V4, and generates the first threshold voltage through subtraction of the voltages V3 and V4. The comparison circuit CMP2 receives the voltages V1 and V2 and generates a second threshold voltage through subtraction of the voltages V1 and V2. The comparison circuit CMP1 calculates a voltage difference between the first differential signal VP and the second differential signal VN, and generates a comparison result CR71 according to comparing the voltage difference between the first differential signal VP and the second differential signal VN and the first threshold voltage. The comparison circuit CMP1 calculates a voltage difference between the first differential signal VP and the second differential signal VN, and generates a comparison result CR72 according to comparing the voltage difference between the first differential signal VP and the second differential signal VN and the second threshold voltage. The logical operation circuit 720 is an exclusive-NOR gate XNOR, and the exclusive-NOR gate XNOR performs calculation on the comparison results CR71 and CR72, and generates an eye diagram detection result Vout. In the present embodiment, the exclusive-NOR gate XNOR can be outputted through the counter 730 to generate the eye diagram detection result Vout according to the clock signal CLK.

In detail, when the voltage difference between the first differential signal VP and the second differential signal VN is greater than the first threshold voltage (voltages V3-V4), it represents that the eye height of the eye diagram of the differential signal pair is high enough, and the comparison circuit CMP1 correspondingly generates the comparison result CR71 which is logical high level. When the voltage difference between the first differential signal VP and the second differential signal VN is greater than the second threshold voltage (voltages V1-V2), it represents that the eye height of the eye diagram of the differential signal pair is low enough, and the comparison circuit CMP2 correspondingly generates the comparison result CR72 which is logical high level, wherein voltage V4>voltage V3>voltage V2>voltage V1.

Incidentally, the voltages V1~V4 can be generated by the DAC 750. Specifically, the DAC 750 can generate the voltages V1~V4 according to digital code. The digit code can be preset in the drive apparatus or can be inputted externally. When the voltage values of the voltages V1~V4 are to be adjusted, the digital code can be changed by external input.

Figure 8:
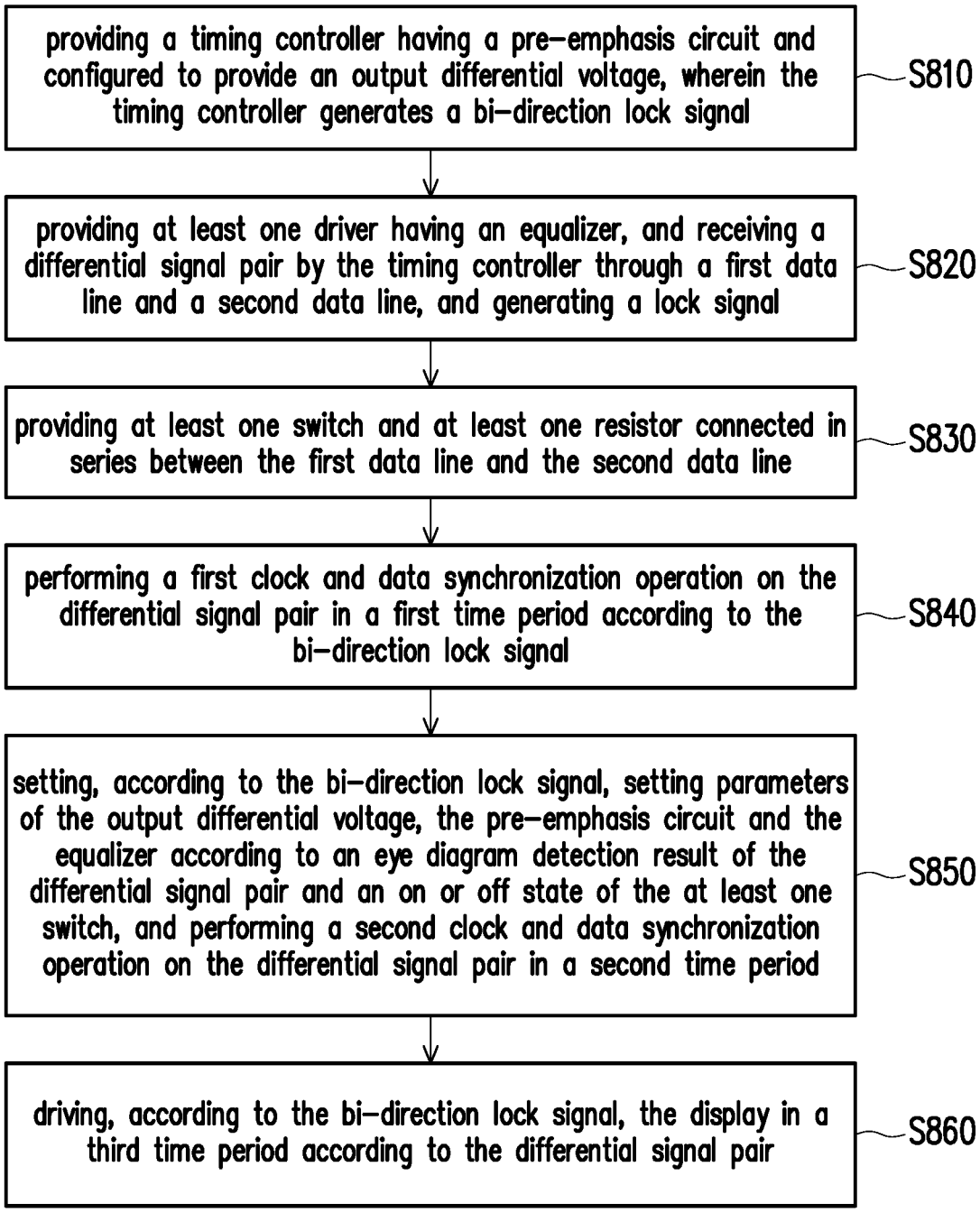
FIG. 8 is a flow chart of a driving signal generating method according to an embodiment of the present disclosure.

Please refer to FIG. 8, FIG. 8 is a flow chart of a driving signal generating method according to an embodiment of the present disclosure. Step S810 provides a timing controller having a pre-emphasis circuit and configured to provide an output differential voltage, wherein the timing controller receives the bi-direction lock signal; step S820 provides at least one driver having an equalizer, and receives the differential signal pair by the timing controller through the first data line and the second data line; step S830 provides at least one switch and at least one resistor connected in series between the first data line and the second data line; step S840 performs, according to the bi-direction lock signal, the first clock and the data synchronization operation on the differential signal pair in the first time period; step S850, according to the bi-direction lock signal, sets the setting parameters of the output differential voltage, the pre-emphasis circuit and the equalizer according to the eye diagram detection result of the differential signal pair and the on or off state of the at least one switch, and performs the second clock and data synchronization operation on the differential signal pair in the second time period; and, step S860, according to the bi-direction lock signal, drives the display according to the differential signal pair in the third time period, wherein the at least one switch is turned on or cut off according to the eye diagram detection result of the differential signal pair. The implementation details of the above steps are described thoroughly in the foregoing various embodiments and implementations, and will not be described here.

In summary, the present disclosure provides a switch on a data line transmitting a differential signal pair to serve as a communication interface between the timing controller and the driver. The driver uses the eye diagram checking mechanism to set the setting parameter of the equalizer, and the timing controller simultaneously checks the on or off state of the switch according to the current detection mechanism, thereby setting the setting parameters of the output differential voltage and the pre-emphasis circuit. In this way, the setting operation of the setting parameters of the output differential voltage, the pre-emphasis circuit and the equalizer can be completed automatically, and the transmission efficiency of the differential signal between the timing controller and the driver can be effectively improved.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A driving apparatus adapted for a display, comprising:

a timing controller, providing an output differential voltage and having a pre-emphasis circuit, the timing controller generating a bi-direction lock signal;

at least one driver, having an equalizer, coupled to the timing controller through a first data line and a second data line and receiving a differential signal pair, the at least one driver generating at least one lock signal;

at least one switch, coupled between the first data line and the second data line, and the at least one switch being turned on or cut off according to an eye diagram detection result of the differential signal pair; and at least one resistor, connected in series with the at least one switch between the first data line and the second data line, wherein, according to the bi-direction lock signal, the timing controller and the at least one driver are configured to:

perform a first clock and data synchronization operation on the differential signal pair in a first time period;

set setting parameters of the output differential voltage, the pre-emphasis circuit and the equalizer according to the eye diagram detection result of the differential signal pair and an on or off state of the at least one switch, and perform a second clock and data synchronization operation on the differential signal pair in a second time period; and drive the display according to the differential signal pair in a third time period.

2. The driving apparatus of claim 1, wherein the timing controller generates the bi-direction lock signal according to the at least one lock signal, the bi-direction lock signal is maintained at a first voltage value during the first time period, the bi-direction lock signal is maintained at a second voltage value during the second time period, and the bi-direction lock signal is maintained at a third voltage value during the third time period, the first voltage value, the second voltage value, and the third voltage value are not the same.

3. The driving apparatus of claim 2, wherein the timing controller transmits a training code to the at least one driver in the first time period, the at least one driver performs the first clock and data synchronization operation according to the training code, and the at least one driver adjusts the at least one lock signal from a fourth voltage value to a fifth voltage value after the first clock and the data synchronization operation is completed.

4. The driving apparatus of claim 3, wherein the timing controller adjusts the bi-direction lock signal to the second voltage value when the at least one lock signal is changed to the fifth voltage value.

5. The driving apparatus of claim 3, wherein in the second time period, the at least one driver adjusts a setting parameter of the equalizer and performs an eye diagram detecting operation on the differential signal pair to generate the eye diagram detection result, the at least one driver cuts off the at least one switch and sets the setting parameter of the equalizer according to the eye diagram detection result.

6. The driving apparatus of claim 5, wherein in the second time period, the timing controller adjusts setting parameters of the output differential voltage and the pre-emphasis circuit, and sets the setting parameters of the output differential voltage and the pre-emphasis circuit according to detection of an on or off state of the at least one switch.

7. The driving apparatus of claim 6, wherein the timing controller and the at least one driver perform the second clock and data synchronization operation after the at least one switch is turned on again.

8. The driving apparatus of claim 7, wherein the at least one driver adjusts the at least one lock signal from the second voltage value to the third voltage value after the second clock and data synchronization operation is completed.

9. The driving apparatus of claim 8, wherein the timing controller adjusts the bi-direction lock signal from the fifth voltage value to a sixth voltage value when the at least one lock signal is adjusted to a third voltage value.

10. The driving apparatus of claim 1, wherein the timing controller comprises:

a current detecting circuit, determining an on or off state of the at least one switch according to detection of a current on the at least one resistor.

11. The driving apparatus of claim 10, wherein the current detecting circuit comprises:

a first buffer, coupled to the at least one switch and the at least one resistor, configured to provide a first bias voltage to the at least one switch and the at least one resistor according to a control signal;

a second buffer, coupled to the at least one switch and the at least one resistor, configured to provide a second bias voltage to the at least one switch and the at least one resistor according to an inverted control signal;

a first comparison circuit, coupled to the at least one switch and the at least one resistor through a first detecting resistor and generating a first comparison result according to comparison of a voltage difference between two terminals of the first detecting resistor;

a second comparison circuit, coupled to the at least one switch and the at least one resistor through a second detecting resistor and generating a second comparison result according to comparison of a voltage difference between two terminals of the second detecting resistor; and a logical operation circuit, performing a logical calculation on the first comparison result and the second comparison result to generate a determining result, wherein the determining result is configured to indicate an on or off state of the at least one switch.

12. The driving apparatus of claim 11, wherein the first buffer comprises:

a first transistor, a first terminal thereof coupled to the first detecting resistor, a second terminal of the first transistor coupled to the at least one switch, and a control terminal of the first transistor receiving the control signal; and a second transistor, a first terminal thereof coupled to a second terminal of the first transistor, a second terminal of the second transistor coupled to a reference ground terminal, and a control terminal of the second transistor receiving the control signal.

13. The driving apparatus of claim 12, wherein the second buffer comprises:

a third transistor, a first terminal thereof coupled to the second detecting resistor, a second terminal of the third transistor coupled to the at least one resistor, and a control terminal of the first transistor receiving the inverted control signal; and a fourth transistor, a first terminal thereof coupled to a second terminal of the third transistor, a second terminal of the fourth transistor coupled to the reference ground terminal, and a control terminal of the fourth transistor receiving the inverted control signal.

14. The driving apparatus of claim 13, wherein the first comparison circuit comprises:

a first operation amplifier;

a first resistor, connected in series between a first terminal of the first detecting resistor and a positive input terminal of the first operation amplifier;

a second resistor, one terminal thereof coupled to the positive input terminal of the first operation amplifier, and the other terminal thereof receiving a reference voltage;

a third resistor, connected in series between a second terminal of the first detecting resistor and a negative input terminal of the first operation amplifier; and a fourth resistor, connected in series between an output terminal of the first operation amplifier and the negative input terminal of the first operation amplifier.

15. The driving apparatus of claim 14, wherein the second comparison circuit comprises:

a second operation amplifier;

a fifth resistor, connected in series between a first terminal of the second detecting resistor and a positive input terminal of the second operation amplifier;

a sixth resistor, one terminal thereof coupled to the positive input terminal of the second operation amplifier, and the other terminal thereof receiving the reference voltage;

a seventh resistor, connected in series between a second terminal of the second detecting resistor and a negative input terminal of the second operation amplifier; and an eighth resistor, connected in series between an output terminal of the second operation amplifier and the negative input terminal of the second operation amplifier.

16. The driving apparatus of claim 1, wherein the at least one driver comprises:

an eye diagram detecting circuit, configured to perform an eye diagram detecting operation on the differential signal pair to generate the eye diagram detection result.

17. The driving apparatus of claim 1, wherein the eye diagram detecting circuit comprises:

a first comparator, receiving a plurality of first differential signals and a plurality of second differential signals corresponding to a plurality of time points, such that a voltage difference between each of the first differential signals and each of the second differential signals is compared with a first threshold voltage to generate a first comparison result;

a second comparator, receiving the plurality of first differential signals and the plurality of second differential signals corresponding to the plurality of time points, such that the voltage difference between each of the first differential signals and each of the second differential signals is compared with a second threshold voltage to generate a second comparison result; and a logical operation circuit, performing a logical calculation on the first comparison result and the second comparison result to generate the eye diagram detection result.

18. The driving apparatus of claim 1, wherein the timing controller and the at least one driver respectively comprise a first counter and a second counter, wherein the first counter and the second counter simultaneously perform a counting operation to generate setting parameters of the output differential voltage, the pre-emphasis circuit, and the equalizer.

19. A driving signal generating method, comprising:

providing a timing controller having a pre-emphasis circuit and configured to provide an output differential voltage, wherein the timing controller generates a bi-direction lock signal;

providing at least one driver having an equalizer, and receiving a differential signal pair by the timing controller through a first data line and a second data line, and generating at least one lock signal;

providing at least one switch and at least one resistor connected in series between the first data line and the second data line;

performing a first clock and data synchronization operation on the differential signal pair in a first time period according to the bi-direction lock signal;

setting, according to the bi-direction lock signal, setting parameters of the output differential voltage, the pre-emphasis circuit and the equalizer according to an eye diagram detection result of the differential signal pair and an on or off state of the at least one switch, and performing a second clock and data synchronization operation on the differential signal pair in a second time period; and driving, according to the bi-direction lock signal, the display in a third time period according to the differential signal pair, wherein the at least one switch is turned on or cut off according to the eye diagram detection result of the differential signal pair.

20. The driving signal generating method of claim 19, further comprising:

providing the timing controller to generate the bi-direction lock signal according to the at least one lock signal, wherein the bi-direction lock signal is maintained at a first voltage value during the first time period, and the bi-direction lock signal is maintained at a second voltage value during the second time period, and the bi-direction lock signal is maintained at a third voltage value during the third time period, the first voltage value, the second voltage value and the third voltage value are not the same.

* * * * *